US008092077B2

(12) United States Patent
Hobor

(10) Patent No.: US 8,092,077 B2
(45) Date of Patent: Jan. 10, 2012

(54) MECHANISM FOR THE POSITIONING OF WRISTWATCH CONTROL ELEMENTS

(76) Inventor: Laszlo Hobor, Devecser (HU)

( * ) Notice: Subject to any disclaimer, the term of this patent is extended or adjusted under 35 U.S.C. 154(b) by 254 days.

(21) Appl. No.: 12/517,354

(22) PCT Filed: Dec. 6, 2007

(86) PCT No.: PCT/HU2007/000119

§ 371 (c)(1),
(2), (4) Date: Jun. 23, 2009

(87) PCT Pub. No.: WO2008/072020

PCT Pub. Date: Jun. 19, 2008

(65) Prior Publication Data

US 2010/0061194 A1 Mar. 11, 2010

(30) Foreign Application Priority Data

Dec. 14, 2006 (HU) ..... 0600911
May 2, 2007 (HU) ..... 0700315

(51) Int. Cl.
*G04B 29/00* (2006.01)

(52) U.S. Cl. ..... 368/319; 368/308

(58) Field of Classification Search ..... 368/306–308, 368/319–321, 286–290
See application file for complete search history.

(56) References Cited

U.S. PATENT DOCUMENTS

| | | | | |
|---|---|---|---|---|
| 2,954,665 | A * | 10/1960 | Panerai et al. | 368/289 |
| 5,742,565 | A * | 4/1998 | Cuinet et al. | 368/190 |
| 6,200,019 | B1 | 3/2001 | Latini | |
| 6,203,189 | B1 * | 3/2001 | Schafer | 368/320 |
| 6,679,624 | B1 * | 1/2004 | Mouawad | 368/216 |
| 7,401,975 | B2 * | 7/2008 | Hiranuma et al. | 368/319 |
| 7,517,139 | B2 * | 4/2009 | Hiranuma et al. | 368/288 |
| 2004/0100869 | A1 * | 5/2004 | Finazzi | 368/1 |
| 2009/0046542 | A1 * | 2/2009 | Saunier | 368/288 |
| 2009/0067297 | A1 * | 3/2009 | Cohen | 368/288 |
| 2010/0128575 | A1 * | 5/2010 | Okuda | 368/308 |

FOREIGN PATENT DOCUMENTS

| | | | |
|---|---|---|---|
| CH | 316833 | A | 10/1956 |
| DE | 3313515 | | 10/1984 |
| DE | 19512680 | | 4/1996 |
| EP | 1205826 | | 5/2002 |
| EP | 1722282 | A1 | 11/2006 |
| WO | WO-86/00152 | | 1/1986 |

* cited by examiner

*Primary Examiner* — Sean Kayes

(74) *Attorney, Agent, or Firm* — Birch, Stewart, Kolasch & Birch, LLP

(57) ABSTRACT

The invention relates to a mechanism for the positioning of wristwatch control elements, whereas such control element may be implemented as a crown intended for the adjustment of the watch—as well as winding up the energy storage spring, for mechanical watches—or a pushbutton, and it is embedded in a hole in the watch case in an axially movable manner. The position mechanism contains a seat for the control element, as well as an actuating element linked to the control element from the side through at least one drive element designed to move the control element in its normal position countersunk in the seat, or one or more elevated operating positions.

18 Claims, 6 Drawing Sheets

MECHANISM FOR THE POSITIONING OF WRISTWATCH CONTROL ELEMENTS

Figure 1:
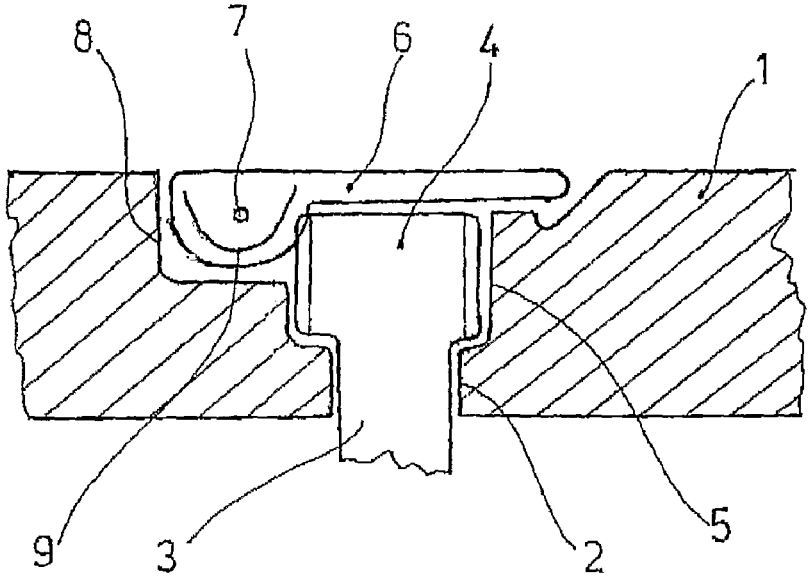

This Application is the National Phase Under 35 U.S.C. §371 of PCT International Application No. PCT/HU2007/000119 which has an International filing date of Dec. 6, 2007, which claims priority to Hungary Application No. P0600911 filed on Dec. 14, 2006 and on Hungary Application No. P0700315 filed on May 2, 2007. The entire contents of all applications listed above are hereby incorporated by reference.

The subject of the invention is a mechanism for positioning the wristwatch control element, whereas such control element is implemented as a crown or a push button intended for the adjustment of the watch as well as for winding up the energy storage spring for mechanical watches, sliding axially in a hole in the watch case.

In the case of wristwatches, the crown or push button stands in way and may get caught in everything in its normal position, that is, almost always. Therefore the watch may inadvertently be reset, set, damaged or bent. Furthermore, this is the weak point, where an axle of the mechanism extends beyond the case, and thereby it is a pivotal location regarding sealing as well.

In the course of time many suggestions emerged to protect and secure controls, particularly the crown, as well as to improve sealing. In the most widely used solution the crown secured by the use of a tough thread (DE 33 13 515, EP 1 205 826). For that reason the crown is provided with an internal thread, and a threaded stub is installed on the outside of the case, containing the crown axis leading to the inside of the case in its central hole, in a way allowing it to turn and move along the axis. These solutions properly secure the crown when it is not used, thereby preventing incidental resetting of the watch, however, they still let the crown protrude from the case.

U.S. Pat. No. 2,954,665 and U.S. Pat. No. 6,200,019 introduce a solution, wherein a lever bridging over the crown is installed on the case. A central hole is made in the case for the crown, from which the edge of the crown protrudes on two sides of the frame. The frame closes the hole radially from the outside. A cam lever turning around an axle is installed in the frame. In closed normal position of the lever the cam is pressed radially onto the external surface of the crown, and presses the crown radially inwards onto the sealing, while securing it. When the lever is turned in open position, the cam recedes from the external crown surface, and thereby the pressure fixing the crown ceases to act. In this open position, the watch can be wound up or set using the crown in the usual manner. However, the frame bridging over the crown hinders and makes unhandy these operations, which lets only the edge of the crown protrude on its two sides, as well as the lever lifted above the crown in its open position.

Our purpose is to create by the invention a mechanism for the protection and axial positioning of the control element of wristwatches, which conceals in a seat the control element that is of no use and troublesome in normal position while not used, and lifts it for use, as well as places it in the proper control position or positions to facilitate access to such control.

According to the invention, the above purpose is attained through such a positioning mechanism, which contains a seat designed for the control element and an actuating element. The actuating element is linked to the control element from the side, through at least one drive element designed to shift the control element in its normal position countersunk in the seat, or one or more elevated operating positions.

In a preferred design of the positioning mechanism the actuating element is a lever turning around an axle placed on one side of the control element orthogonally to the longitudinal centre line of control element, which is at least partly countersunk in a seat in its normal position, from which it is turned out into the operating position. In further preferred designs, the actuating element is a slide or an actuating wheel. The drive element is preferably led into a circumferential groove implemented on the control element in a plane orthogonal to the longitudinal centre line of the control element. The drive element is practically implemented as a telescopic lever, which can be compressed against the spring force, and in its normal position, it forms an bevel with the corner turned inward with the longitudinal centre line of the of control element, being self fastening in the meantime. The drive element can be linked in the circumferential groove through a roller or fork joint, for example.

In another preferred design, the drive element is a cog, ribbed or grooved wheel, roller or arch, and grooves or ribs with a profile corresponding to that of the cog, ribbed or grooved wheel, roller or arch are implemented all around the crown in planes orthogonal to the longitudinal centre line of the crown.

The actuating element can be placed practically anywhere along the boundary of the case, provided that the actuating element is interconnected with the drive element linked to the control element through at least one intermediate element.

Favorably, a support element with a profile identical with that of the drive element is connected to the control element in front of the drive element, on the opposite side of the control element. The support element can be practically an idler wheel or arch, or at least, it should be interlocked with the drive element through an intermediate element.

The intermediate element is preferably a gear rack, a cog wheel or a gear rim.

In many implementations, the solution is preferred, where the actuating element acting as an actuating lever is turned over the outer end of the control element in its closed position.

The positioning mechanism can be either installed in the case of the watch, or fastened to the case of the watch from the outside.

Figure 3:
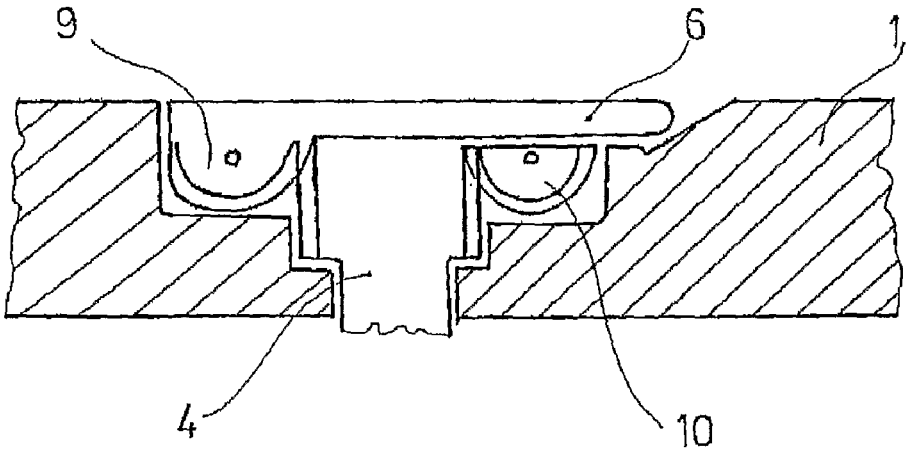
Figure 4:
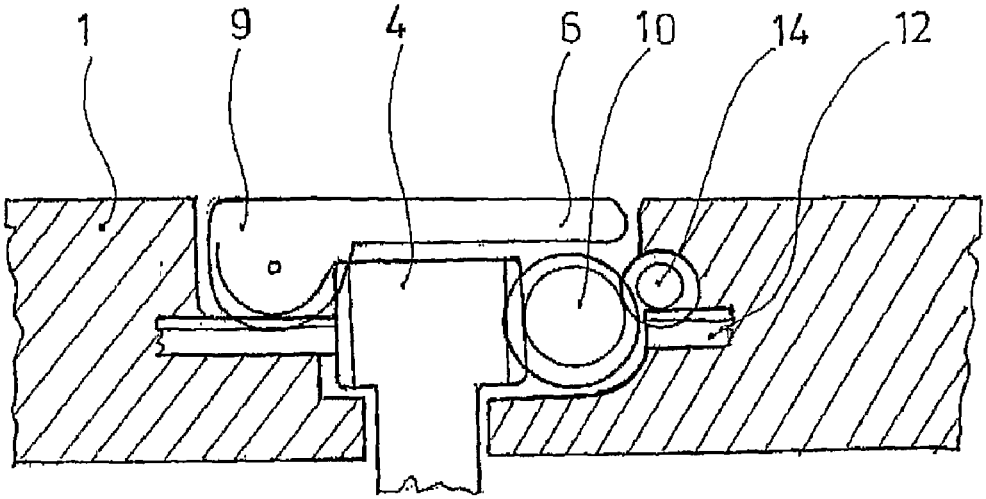
Figure 5:
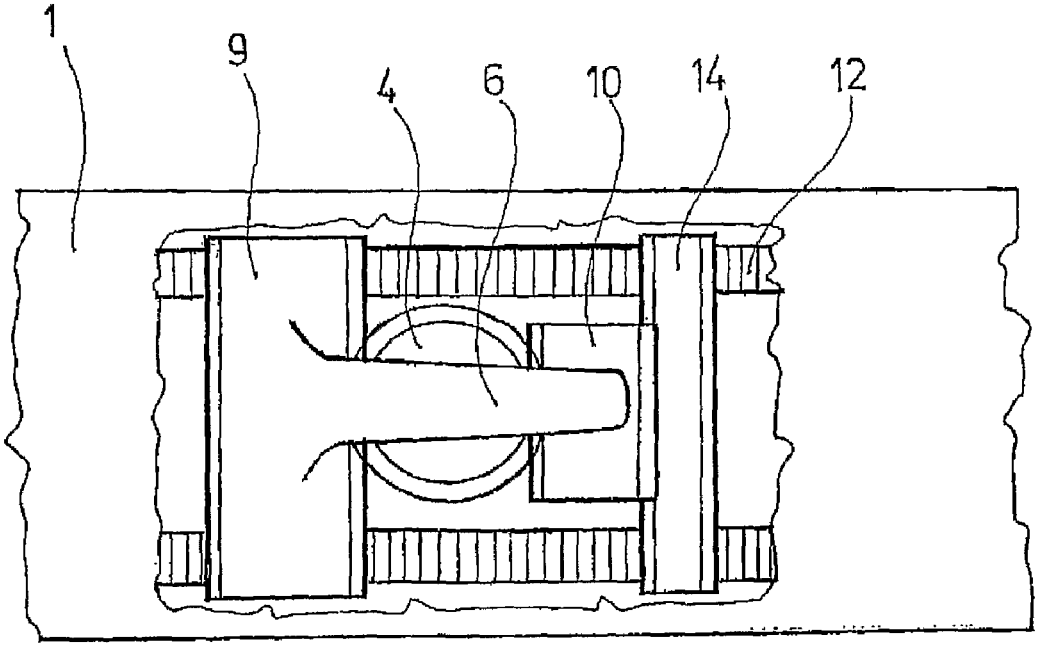
Figure 8:
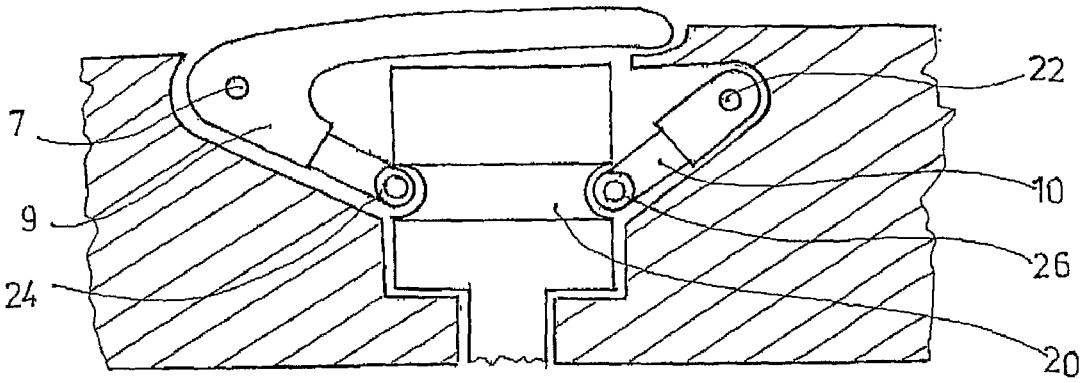
Figure 6:
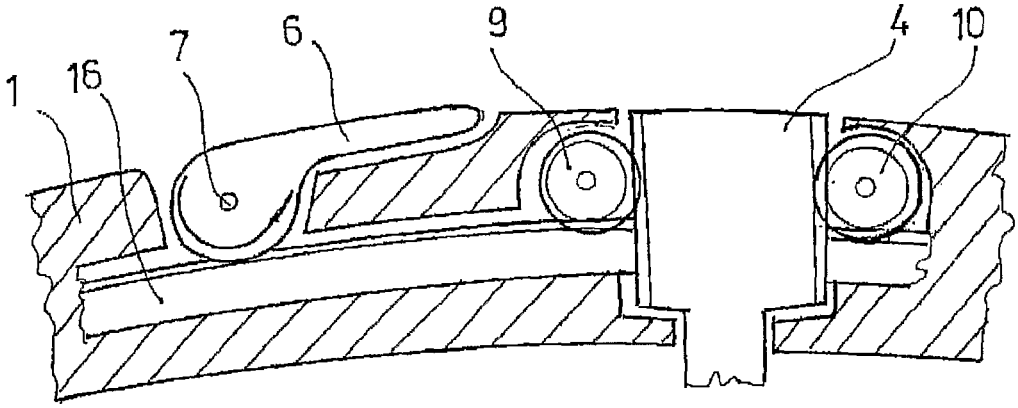
Figure 7:
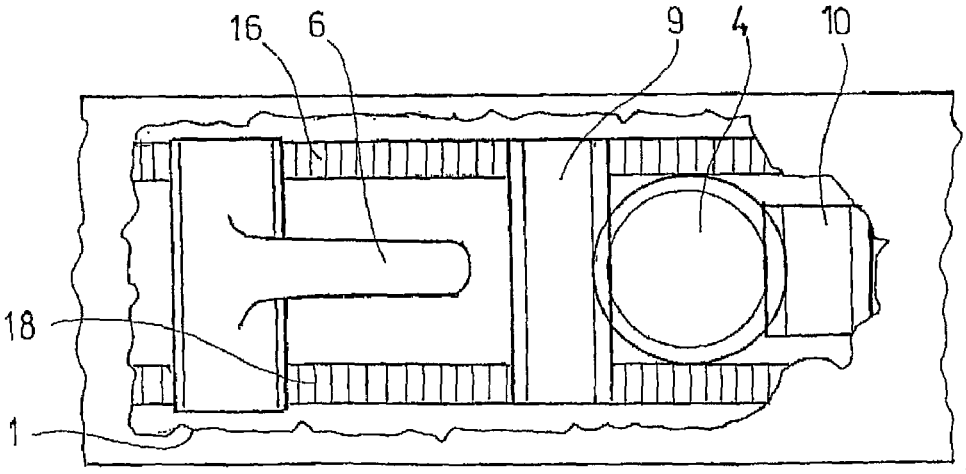
Figure 9:
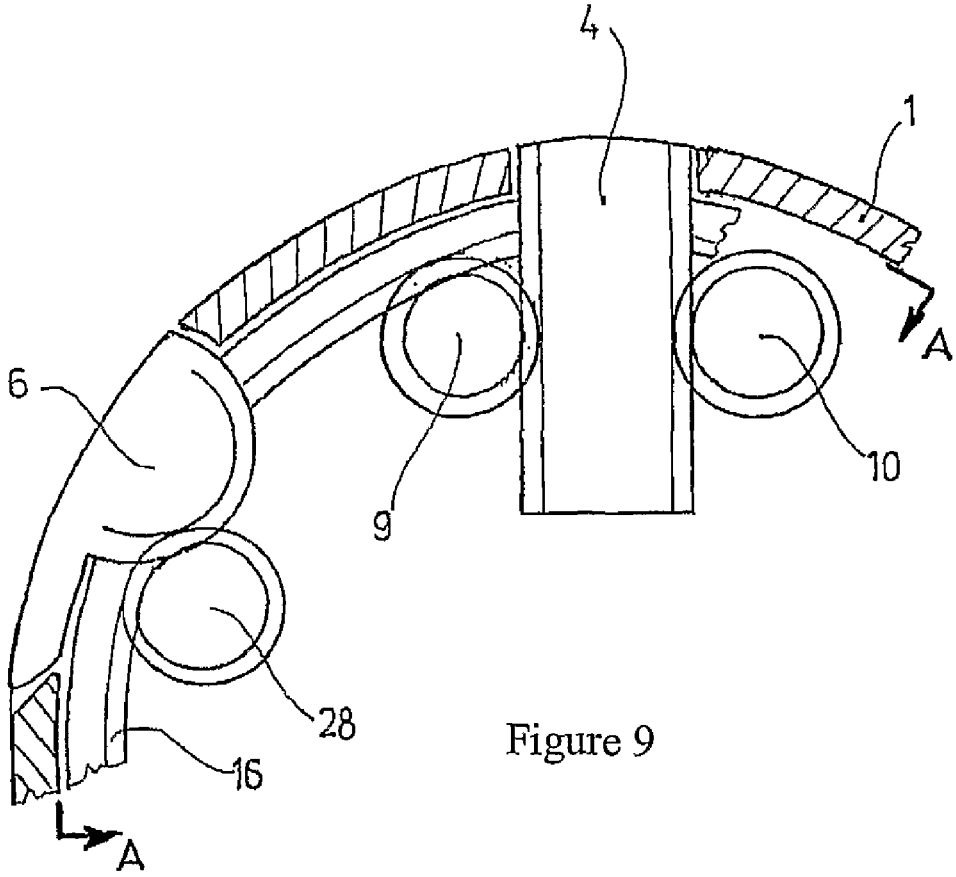
Figure 10:
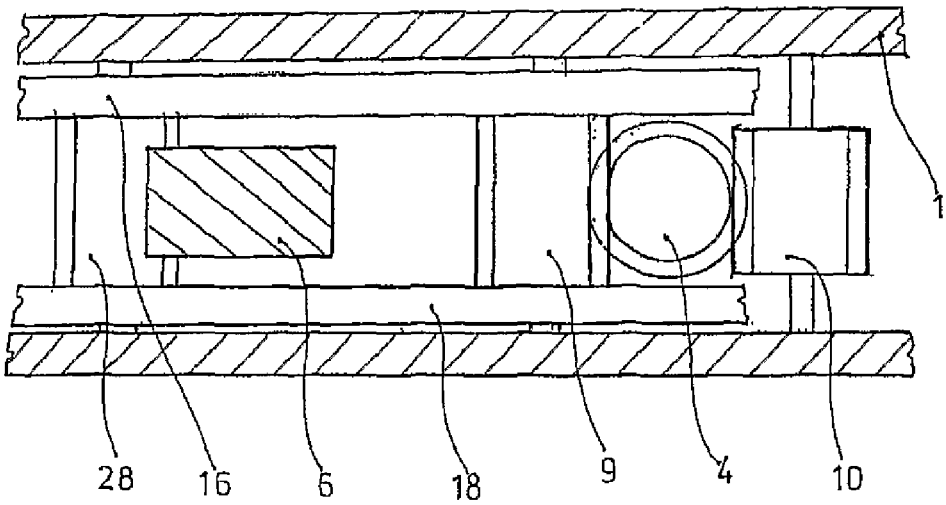
Figure 11:
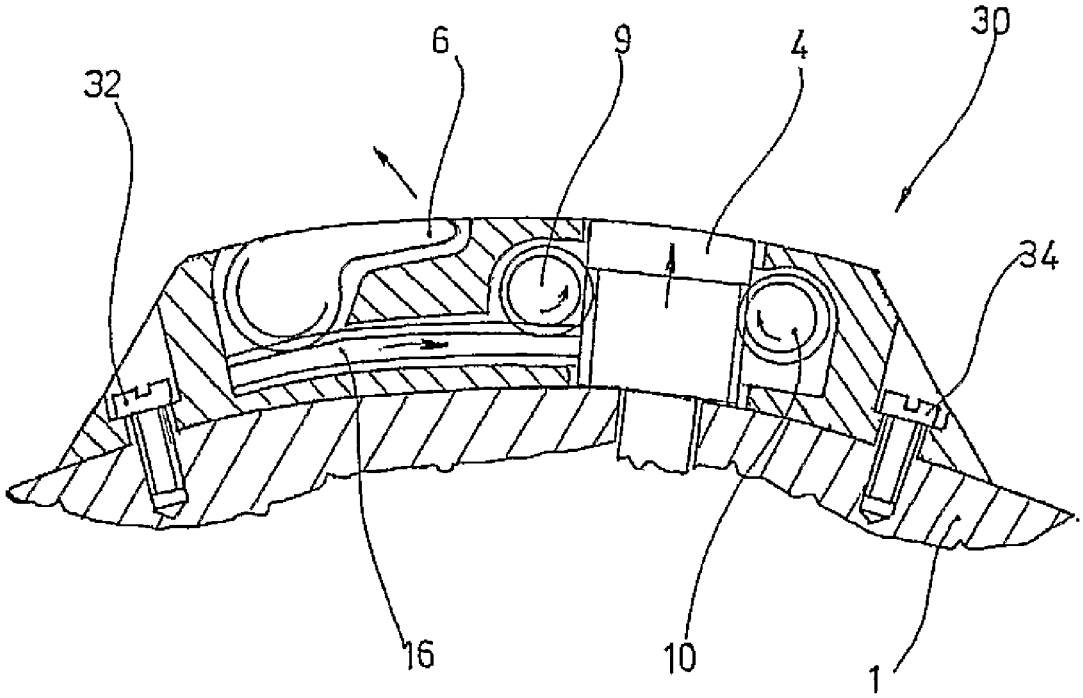
Figure 12:
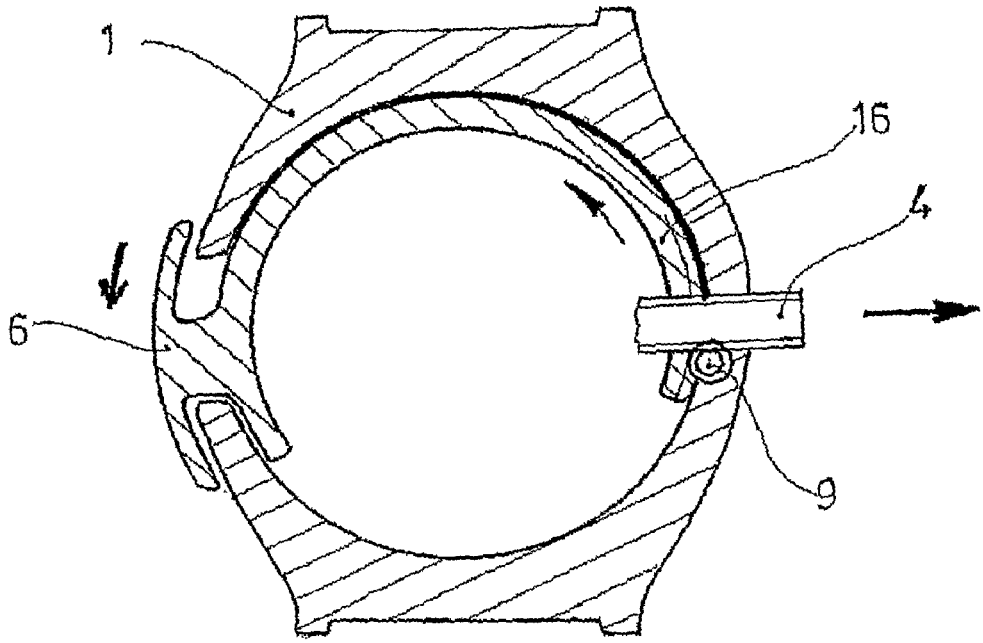
Figure 13:
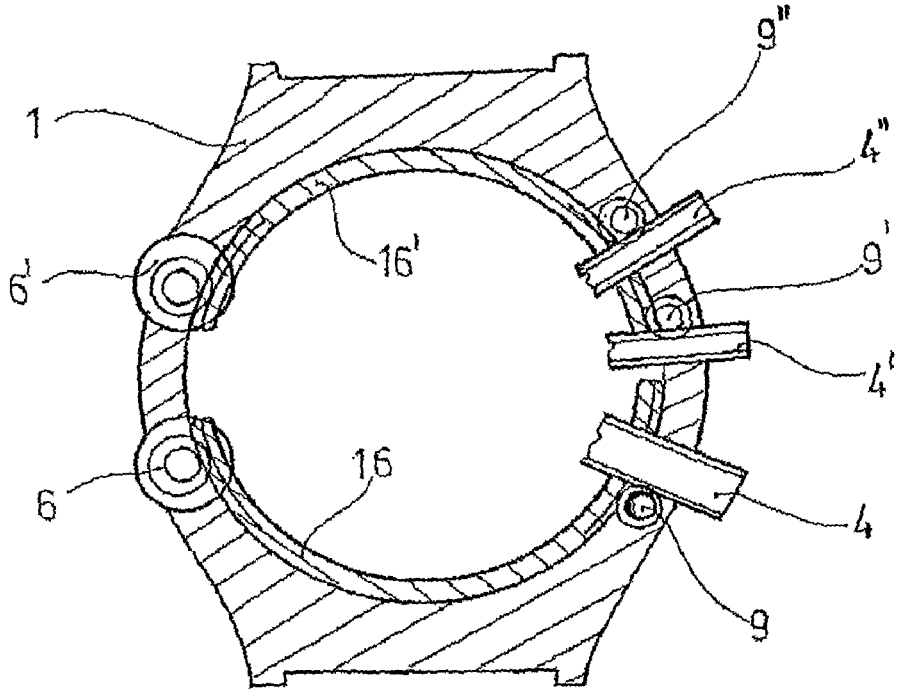

In the following, we shall introduce the invention in detail, based on sample implementations and drawings. The drawings illustrate in FIGS. 1 and 2: a part of a wristwatch showing the first preferred embodiment of the positioning mechanism according to the invention in cross-sectional and front views;

in FIG. 3: the second preferred embodiment of the invention containing a support element in cross-sectional view;

in FIGS. 4 and 5: the third preferred embodiment of the invention with the drive element being interlocked with the support element, in cross-sectional, front and broken-out sectional views;

in FIGS. 6 and 7: the fourth preferred embodiment of the invention with the drive element being linked to the actuating element through intermediate elements, in cross-sectional, front and broken-out sectional views;

in FIG. 8: the fourth preferred embodiment of the invention with the drive and support element being implemented as a telescopic lever, in cross-sectional view;

in FIG. 9: the sixth preferred embodiment of the invention with the drive element being linked to the actuating element through intermediate elements, in cross-sectional view;

in FIG. 10: the sectional view of FIG. 9 along its line A-A, in FIG. 11: a further preferred embodiment of the invention in cross-sectional view, in which the positioning mechanism is implemented as a separate module, and attached to the case of the watch from the outside;

in FIGS. 12 and 13: further preferred embodiments in sectional sketches.

Figure 2:
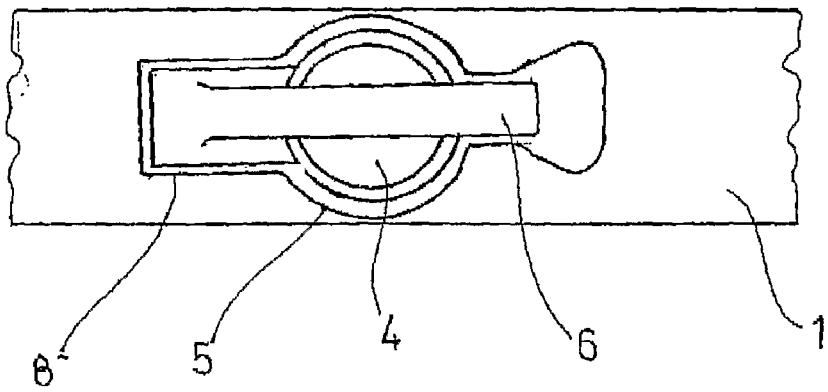

FIGS. 1 and 2 show a part of a wristwatch equipped with a simple embodiment of the positioning mechanism according to the invention, in cross-sectional and front views. The wristwatch has a case (1) and a control element (4) embedded in the hole (2) of the case (1) in a way allowing axial movement. The inner end of the axle (3) of the control element (4) is linked to the clockwork installed in the case (1). The control element (4) is implemented as crown—used for winding up the energy storage spring, for mechanical watches—or a push button intended for the adjustment of the watch. The positioning mechanism contains a seat (5) opening radially outwards and implemented for the control element (4) in the case (1), as well as an actuating element (6). In the sample illustrated, the actuating element (6) is implemented as an actuating lever turning around an axle (7). The axle (7) or the actuating element (6) is orthogonal to the longitudinal centre line of the control element (4), and it is shifted to one side from the control element (4). The actuating element (6) is linked to the control element (4) from the side, through a drive element (9) designed to move the control element (4) in its normal position countersunk in the seat (5), or one or more elevated operating positions. In its normal position, the actuating element (6) is turned over the outer end of the control element (4), and it is at least partly countersunk in a seat (8), and while the control element (4) is in any of its one or more operating positions, the actuating element (6) is turned out of the seat (8). Through a drive element (9), the actuating element (6) is linked to the control element (4), which can thereby be moved into either its normal position countersunk in the seat (5), or one or more elevated operating positions.

In the embodiment illustrated in FIG. 1, the drive element (9) is a cog arch. In order to implement the connection between the drive element (9) and the control element (4), grooves and ribs of profiles identical to that of the segment gear are developed on the control element (4), which run around the side of the control element (4) along planes orthogonal to the longitudinal centre line of the control element (4).

In other similar designs, the drive element (9) can be implemented, instead of the segment gear illustrated here, through the use of a cog wheel or roller, or ribbed or grooved wheel, roller or arch, for example; the profile of the side of the control element (4) is always designed so that it connects slip-free to the drive element (9).

In the embodiment shown in FIG. 3, a support element (10) is connected to the control element (4) in front of the drive element (9), on the opposite side of the control element (4). This support element (10) relieves the control element (4) from the lateral force component originating from the drive element (9). In the example illustrated, the support element (10) is an idler segment gear with its profile identical to the drive element (9).

In the embodiments illustrated in FIGS. 4 and 5, the support element (10) is a cog roller, which is interlocked with the drive element (9) through intermediate elements (12) and (14). In the embodiment illustrated, the intermediate element (12) is a gear rack connecting the drive element (9) to the intermediate element (14). Intermediate element (14) is a cog roller linked to the support element (10). Thereby, the control element (4) is actuated from both sides in a symmetrical manner.

In the preferred embodiment illustrated in FIGS. 6 and 7, the actuating element (6) is linked to the drive element (9) connected to the control element (4) through intermediate elements (16) and (18). Intermediate elements (16) and (18) can be either gear racks or gear rims. The latter runs all around in the case (1), and therefore, the actuating element (6) can be placed practically anywhere along the boundary of the case (1), even opposite the control element (4). A single intermediate element (16) or (18) is already sufficient for the operation; the other one serves for balancing the torque.

FIG. 8 illustrates a preferred embodiment, wherein the drive element (9) is led into a circumferential groove (20) implemented on the side of the control element (4) in a plane orthogonal to the longitudinal centre line of the control element (4). The drive element (9) is practically implemented as a telescopic lever, which can be compressed against the spring force. In its normal position, the telescopic lever forms an bevel with the corner turned inward with the longitudinal centre line of the of control element (4), and therefore, it exerts a force acting inward and fixing the control element (4) in its normal position, whereby the mechanism becomes self-fastening. The lateral force acting on the control element (4) is balanced by the support element (10) placed in front of the drive element (9). The support element (10) is such a telescopic lever of a design identical to the drive element (9), which can turn around the axle (22) embedded in the case (1). The drive element (9) and the support element (10) connect to the circumferential groove (20) through rollers (24) and (26).

Such additional embodiments—not illustrated herein—are also possible, wherein the drive element (9) is of an alternative design, and for example, connects to the circumferential groove (20) through a fork joint.

The preferred embodiment illustrated in FIGS. 9 and 10 is similar to the solution shown in FIGS. 6 and 7, except that the teeth of the intermediate elements (16) and (18) implemented as gear rims are looking inwards, and they connect to the actuating element (6) through an additional intermediate element (28) of a cog roller design. Due to the inner gearing of the intermediate element (16), the intermediate element (28), the drive element (9) linked to the control element (4), and the support element (10) relieving the load from the control element (4) are all entirely located inside the case (1). From the outside, it is only the contour of the control element (4) and the actuating element (6) that can be seen on the surface of the case (1). Since, similarly to the embodiment illustrated in FIGS. 6 and 7, the actuating element (6) is relatively far from the control element (4), the latter protrudes from the case (1) in an especially well accessible, solitary way.

In the embodiments described so far, the positioning mechanism is installed in the case of the watch. Alternatively, in another preferred embodiment of the invention outlined in FIG. 11, the positioning mechanism is implemented as a separate module (30) embedded in a thin metal block, and it is fastened to the case (1) of a watch using fixing bolts (32) and (34). Notwithstanding this, the design and operation of the positioning mechanism illustrated herein is identical to the already described embodiment shown in FIGS. 6 and 7. The directions of the displacements occurring upon the lifting of the actuating element (6) are indicated by the arrows. Certainly, the other embodiments can also be realized as modules; an especially preferred one is the mechanism shown in FIGS. 9 and 10.

It is possible to install the module on any wristwatch subsequently; this requires minor transformations, such as the drilling of holes in the original case for the fixing bolts, and the replacement of the control element. To achieve a visually thinner module, the case can be slightly fined down.

The modular design can be applied in such cases as well, where the wall thickness of the original case does not allow the installation of the positioning mechanism being the subject of the invention in the case.

The shape of the module can be adjusted to any case form. For the sake of symmetry, a profile with no function and of a shape identical to the module can be bolted on the side of the case opposite the module.

The embodiments shown in FIGS. 12 and 13 are similar to the solution described in FIG. 6, except that, in these examples, the actuating element (6) is not implemented as an actuating lever, but as a slide or actuating wheel.

In FIG. 12, the actuating element (6) is a slide moving along the boundary of the case (1), which is linked with the control element (4)—illustrated in elevated position—through the intermediate element (16) firmly connected with the former, and the drive element (9). The directions of the displacements occurring upon lifting are indicated by arrows.

The wristwatch illustrated in FIG. 13 has control elements (4), (4') and (4"), as well as actuating elements (6) and (6'). Actuating elements (6) and (6') are actuating wheels connected to the intermediate elements (16) and (16') through cog wheels, and the intermediate elements (16) and (16') are linked to control elements (4), (4') and (4") through drive elements (9), (9') and (9"). In the example illustrated, the control element (4) is a crown, while control elements (4') and (4") are push buttons.

If the control element is a push button, it must be detached from the positioning mechanism after lifting, and the interlocking required for its operation must be provided for in this position. This can be achieved, for example, through one or more ribs implemented on the axle of the push button along a 45° range. Therefore, in order to enable its operation, the push button is lifted using the positioning mechanism, turned, and then pushed, and to lock it again, it must be turned and dropped back. Because of the turns required for interlocking, the push buttons should be added axial grooves—similarly to the crown.

In the various embodiments of the invention, the control element can be placed on either side of the pins—subject to the construction—, and moved either directly or through a driving gear. In normal position, that is, whenever out of use, the control element is countersunk in a dedicated seat, from which it is pulled out using the actuating element for adjusting or winding up the watch, if applicable, for the necessary period of time only. In this position, the control element is freely accessible, and it can be operated similarly to any other watch. This solution enables to protect the control element against mechanical damages, as well as to provide the watch an authentic design element.

The invention claimed is:

1. A mechanism for the positioning of a wristwatch control element, said control element being possibly implemented as a crown intended for the adjustment of the watch—as well as winding up the energy storage spring, for mechanical watches—or a push button, and embedded in a hole in the watch case in an axially movable manner, wherein the positioning mechanism contains a seat for the control element (4), into which seat the control element is countersunk in a normal position and from which seat the control elements is elevated into one or more operating positions, the positioning mechanism contains an actuating element, said actuating element being a slide, an actuating wheel or a lever that may be turned about an axle disposed perpendicular to a longitudinal axis of the control element, said positioning mechanism containing at least one drive element disposed between the actuating element and the control element such that the drive element is connected from the side to the control element, and a support element connected to the control element in front of the drive element, on the opposite side of the control element to the drive element.

2. The mechanism for the positioning of a wristwatch according to claim 1, wherein the actuating element is a slide.

3. The mechanism for the positioning of a wristwatch according to claim 1, wherein the actuating element is an actuating wheel.

4. A mechanism for the positioning of a wristwatch control element, such control element being possibly implemented as a crown intended for the adjustment of the watch—as well as winding up the energy storage spring, for mechanical watches—or a push button, and embedded in hole in a watch case in an axially movable manner, wherein the positioning mechanism contains a seat for the control element, into which seat the control element is countersunk in a normal position and from which seat the control elements is elevated into one or more operating positions, the positioning mechanism contains an actuating element which is a lever that may be turned about an axle disposed perpendicular to a longitudinal axis of the control element, the positioning mechanism contains at least one drive element disposed between the actuating element and the control element such that the drive element is connected from the side to the control element, and a support element connected to the control element in front of the drive element, on the opposite side of the control element to the drive element.

5. The mechanism for the positioning of a wristwatch according to claim 4, wherein the actuating element is placed on one side of the control element which is at least partly countersunk in a seat in its normal position, from which it is turned out in operating position.

6. The mechanism for the positioning of a wristwatch according to claim 5, wherein the actuating element acting as an actuating lever is turned over an outer end of the control element in a closed position.

7. The mechanism for the positioning of a wristwatch according to claim 4, wherein the drive element is led into a circumferential groove implemented on the control element in a plane orthogonal to its longitudinal centre line.

8. The mechanism for the positioning of a wristwatch according to claim 7, wherein the drive element is implemented as a telescopic lever, which can be compressed against a spring force.

9. The mechanism for the positioning of a wristwatch according to claim 7, wherein, in its normal position, the telescopic lever forms a bevel with the corner turned inward with the longitudinal centre line of the control element.

10. The mechanism for the positioning of a wristwatch according to claim 7, wherein the drive element is linked into the circumferential groove through a roller.

11. The mechanism for the positioning of a wristwatch according to claim 7, wherein the drive element is linked into the circumferential groove through a fork joint.

12. The mechanism for the positioning of a wristwatch according to claim 4, wherein the drive element is a cog, ribbed or grooved wheel, roller or arch, and grooves or ribs with a profile corresponding to that of the cog, ribbed or grooved wheel, roller or arch are implemented all around the control element in planes orthogonal to the longitudinal centre line of the same.

13. The mechanism for the positioning of a wristwatch according to claim 4, wherein the actuating element is interconnected with the drive element linked to the control element through at least one intermediate element.

14. The mechanism for the positioning of a wristwatch according to claim 13, wherein the intermediate element is a gear rack, a cog wheel, a cog roller or a gear rim.

15. The mechanism for the positioning of a wristwatch according to claim 4, wherein the support element is an idler wheel or arch.

16. The mechanism for the positioning of a wristwatch according to claim 4, wherein the support element is interlocked with the drive element through at least one intermediate element.

17. The mechanism for the positioning of a wristwatch according to claim 4, wherein said mechanism is installed in the case of the watch.

18. The mechanism for the positioning of a wristwatch according to claim 4, where said mechanism is implemented as a module fastened externally on the case of the watch.

* * * * *